US010653286B2

(12) United States Patent
Mirle et al.

(10) Patent No.: US 10,653,286 B2
(45) Date of Patent: May 19, 2020

(54) CLEANING ARTICLE WITH PREFERENTIAL COATING

(71) Applicant: The Procter & Gamble Company, Cincinnati, OH (US)

(72) Inventors: Srinivas Krishnaswamy Mirle, Liberty Township, OH (US); David John Pung, Loveland, OH (US); Steven Louis Puleo, Huntington, CT (US)

(73) Assignee: The Procter & Gamble Company, Cincinnati, OH (US)

( * ) Notice: Subject to any disclaimer, the term of this patent is extended or adjusted under 35 U.S.C. 154(b) by 273 days.

(21) Appl. No.: 15/726,568

(22) Filed: Oct. 6, 2017

(65) Prior Publication Data

US 2019/0104910 A1 Apr. 11, 2019

(51) Int. Cl.
*A47L 13/17* (2006.01)
*A47L 13/38* (2006.01)

(52) U.S. Cl.
CPC ..... *A47L 13/17* (2013.01); *A47L 13/38* (2013.01)

(58) Field of Classification Search
CPC ..... A47L 13/16–20
See application file for complete search history.

(56) References Cited

U.S. PATENT DOCUMENTS

| | | | | |
|---|---|---|---|---|
| 823,725 | A | 6/1906 | Hayden | |
| 3,494,821 | A | 2/1970 | Evans | |
| 3,629,047 | A | 12/1971 | Davison | |
| 4,144,370 | A | 3/1979 | Boulton | |
| 4,145,787 | A | 3/1979 | Bastian | |
| 4,808,467 | A | 2/1989 | Suskind et al. | |
| 5,144,729 | A | 9/1992 | Austin et al. | |
| 5,525,397 | A | 6/1996 | Shizuno et al. | |
| 5,691,035 | A | 11/1997 | Chappell et al. | |
| 6,143,393 | A | 11/2000 | Abe et al. | |
| 6,241,835 | B1 | 6/2001 | Abe et al. | |
| 6,243,909 | B1 * | 6/2001 | Graham | A47L 13/20 15/1.52 |
| 6,245,413 | B1 | 6/2001 | Fujiwara et al. | |
| 6,319,593 | B1 | 11/2001 | Kenmochi et al. | |
| 6,329,308 | B1 | 12/2001 | Kenmochi et al. | |
| 6,550,092 | B1 | 4/2003 | Brown et al. | |
| 6,554,937 | B1 | 4/2003 | Kenmochi et al. | |
| 6,774,070 | B1 | 8/2004 | Kenmochi et al. | |
| 6,777,064 | B1 | 8/2004 | Brown et al. | |
| 6,797,357 | B2 | 9/2004 | Fereshtehkhou et al. | |
| 6,813,801 | B2 | 11/2004 | Tanaka et al. | |
| 6,830,801 | B1 | 12/2004 | Kenmochi et al. | |
| 6,936,330 | B2 | 8/2005 | Fereshtehkhou et al. | |

(Continued)

FOREIGN PATENT DOCUMENTS

WO WO-2012158403 A2 * 11/2012 ..... A47L 13/16

OTHER PUBLICATIONS

14958 PCT search report for appl. No. PCT/US2018/053053,dated Dec. 21, 2018, 12 pages.

*Primary Examiner* — Shay Karls
(74) *Attorney, Agent, or Firm* — John T. Dipre

(57) ABSTRACT

A cleaning article for cleaning a target surface. The cleaning article has a coating of soy oil, to improve debris capture and retention. The soy oil is substantially un-hydrogenated, which further improves processability, without sacrificing debris capture and retention over commonly used and more highly hydrogenated soy oil.

8 Claims, 4 Drawing Sheets

(56) References Cited

U.S. PATENT DOCUMENTS 6,984,615 B2 1/2006 Kenmochi et al.
7,003,856 B2 2/2006 Hayashi et al.
7,291,359 B2 11/2007 Haskett et al.
7,386,907 B2 6/2008 Otsuka et al.
7,560,398 B2 7/2009 Zillig et al.
7,566,671 B2 7/2009 Hoadley et al.
7,682,686 B2 3/2010 Curro et al.
7,712,178 B2 5/2010 Yamada et al.
7,779,502 B2 8/2010 Fujiwara et al.
7,786,030 B2 8/2010 Tsuchiya
7,803,726 B2 * 9/2010 Policicchio ..... A47L 13/38 15/229.2
7,838,099 B2 11/2010 Curro et al.
7,870,635 B2 1/2011 Yamada et al.
7,937,797 B2 5/2011 Tsuchiya et al.
8,075,977 B2 12/2011 Curro et al.
8,093,192 B2 1/2012 Liu et al.
8,146,197 B2 4/2012 Yamada
8,151,402 B2 4/2012 Takabayashi et al.
8,161,001 B2 4/2012 Di Carlo et al.
8,161,594 B2 4/2012 Policicchio et al.
8,225,453 B2 7/2012 Yamada
8,245,349 B2 8/2012 Tsuchiya et al.
8,435,625 B2 5/2013 Ruehe et al.
8,528,151 B2 9/2013 Przepasniak
8,536,074 B2 9/2013 Fereshtehkhou et al.
8,617,685 B2 12/2013 Yamada
8,646,144 B2 2/2014 Wada et al.
8,752,232 B2 6/2014 Otsuka et al.
8,756,746 B2 6/2014 Policicchio
8,763,197 B2 7/2014 Policicchio et al.
8,793,832 B2 8/2014 Yamada
8,851,776 B2 10/2014 Schwarz et al.
8,931,971 B2 * 1/2015 Schwarz ..... A46B 11/0062 15/209.1
9,113,768 B2 8/2015 Wada et al.
9,198,553 B2 12/2015 Policicchio
9,204,775 B2 12/2015 Pung et al.
9,296,176 B2 3/2016 Escaffre et al.
9,339,165 B2 5/2016 Vetter et al.
9,486,991 B2 11/2016 Nobukuni
9,974,424 B2 5/2018 Roe et al.
2003/0171051 A1 9/2003 Bergsten et al.
2004/0163674 A1 * 8/2004 Policicchio ..... A47L 13/17 134/6
2006/0171764 A1 8/2006 Hoadley et al.
2014/0053870 A1 2/2014 Tuman et al.

* cited by examiner

CLEANING ARTICLE WITH PREFERENTIAL COATING

FIELD OF THE INVENTION

The present invention relates to hard surface cleaning articles having an effective type of soy oil coating thereon.

BACKGROUND OF THE INVENTION

Various cleaning articles have been created for dusting and light cleaning. For example, cloth rags and paper towels used dry or wetted with polishing and cleaning compositions have been used on relatively flat surfaces such as countertops, showers, sinks and floors. Laminiferous wipes have been proposed, as disclosed in U.S. Pat. No. 9,296,176. But, rags, wipes, and paper towels are problematic for reasons such as hygiene (the user's hands may touch chemicals, dirt or the surface during cleaning), reach (it may be difficult to insert the user's hand with the rag, wipe or paper towel into hard-to-reach places) and inconvenience (cleaning between closely-spaced articles typically requires moving the articles).

To overcome the problems associated with using rags and paper towels, various reusable dust gathering devices using felt and hair have been utilized for more than a century, as illustrated by U.S. Pat. No. 823,725 issued in 1906 to Hayden and using yarns as illustrated in U.S. Pat. No. 4,145,787. To address the problems with reusable dust gathering devices, disposable cleaning articles have been developed which have limited re-usability. These disposable cleaning articles may include synthetic fiber bundles, called tow fibers, attached to a sheet as shown in U.S. Pat. Nos. 6,241,835; 6,329,308; 6,554,937; 6,774,070; 6,813,801; 7,003,856; 7,566,671; 7,712,178; 7,779,502; 7,937,797; 8,146,197; 8,151,402; 8,161,594, 8,186,001; 8,245,349; 8,646,144; 8,528,151; 8,617,685; 8,756,746; 8,763,197; 9,113,768 and 9,198,553.

For cleaning of floors and other hard surfaces, various cleaning sheets have been used in conjunction with various cleaning implements. The sheets are removably attachable to the cleaning implement, which allows the user to remain upright and provides ergonomic convenience. For example, microfiber cleaning pads have been used for wet and dry cleaning of floors and other target surfaces. Microfiber pads may be nylon and are intended to be washed and reused. But microfiber pads may damage the floor and still leave filming/streaking, particularly after repeated washings.

Accordingly, nonwoven cleaning sheets have been used, particularly for cleaning of dry target surfaces. Nonwoven cleaning sheets are typically discarded after a single use, and not laundered or otherwise restored. Nonwoven sheets for cleaning hard surfaces, such as floors, countertops, etc., are known in the art as shown in U.S. Pat. Nos. 3,629,047 and 5,144,729. To provide durability, a continuous filament or network structure has been proposed, as disclosed in U.S. Pat. Nos. 3,494,821; 4,144,370 and 4,808,467 and polymers as described in U.S. Pat. No. 5,525,397. Other attempts include providing a surface which is textured with peaks and valleys for trapping debris as disclosed in commonly assigned U.S. Pat. No. 6,797,357.

Nonwoven sheets having tow fibers have been proposed, as disclosed in U.S. Pat. Nos. 6,143,393; 8,225,453; 8,617,685; 8,752,232; 8,793,832 and in commonly assigned U.S. Pat. No. 8,075,977. Webs with elastic behavior have been proposed in commonly assigned U.S. Pat. No. 5,691,035. Sheets with recesses have also been proposed, as disclosed in U.S. Pat. Nos. 6,245,413; and 7,386,907. Sheets with cavities have been proposed, as disclosed in U.S. Pat. No. 6,550,092. An adhesive cleaning sheet is proposed in U.S. Pat. No. 7,291,359. But these attempts require additional complexity in the manufacture of the nonwoven.

Yet other attempts use coatings of wax and/or oil. Coatings of wax and oil are generally disclosed in U.S. Pat. Nos. 6,550,092; 6,777,064; 6,797,357; 6,936,330; 7,386,907; 7,560,398; 8,435,625; 8,536,074; 9,204,775; 9,339,165 and EP 1482828. Commonly assigned US 2004/1063674 teaches a mineral oil. Specific amphiphilic coatings are disclosed in U.S. Pat. No. 8,851,776. U.S. Pat. No. 8,093,192 teaches partially hydrogenated soy oil, but does not recognize how to use the oil for hard surface cleaning or for processing a cleaning article. Swiffer® Dusters, sold by the instant assignee, have been sold with up to 7 weight percent oil for off-the-floor cleaning.

But even these teachings do not address the proper type of soy oil coatings for a cleaning article. Too little coating is not efficacious. Coating which is sufficient to be efficacious often contaminates production machinery, requiring maintenance and cleaning. Such coating can also leave unsightly residue on the target surface during a cleaning task.

Thus the type of coating should also be considered. Applicant has unexpectedly found that even small variations in processing the coating raw materials can have a significant effect on coating efficacy. Particularly, soy oil has been tried as a raw material for coatings. Soy oil is commercially processed and sold in a hydrogenated or partially hydrogenated form for use. Hydrogenation is the process of adding hydrogen to a substance for the purpose of converting double bonds between an alkene into single bonds, forming alkanes. Hydrogenation generally hardens a coating. Generally harder coatings are easier to process, for manufacturing operation operations such as cutting, folding and stacking of substrates. But hard, solid coatings generally do not perform as well in use as softer, liquid coatings for attracting and retaining dust, lint and particulates on a nonwoven. Coatings are potentially more spreadable, when in a liquid state, increasing collection and retention of debris during cleaning. Thus, one of skill making a coating for a hard surface cleaning article has to face the dilemma of the tradeoff between processability and cleaning efficacy.

Accordingly, this invention addresses the problem of how to incorporate the proper type of soy oil into a coating for a cleaning article without sacrificing cleaning efficacy while providing processability in manufacture. Applicant has unexpectedly found a particular type of soy oil which is decouples the tradeoff between efficacy and processability.

SUMMARY OF THE INVENTION

The invention comprises a cleaning article for cleaning a target surface. The cleaning article comprises a sheet having a first surface and second surface opposed thereto. A coating having soy oil is disposed on the sheet for retaining debris. The soy oil has less than 45% hydrogenation, resulting in an iodine Value greater than 90.

BRIEF DESCRIPTION OF THE DRAWINGS

All graphs are drawn to scale.

DETAILED DESCRIPTION OF THE INVENTION

Figure 1A:
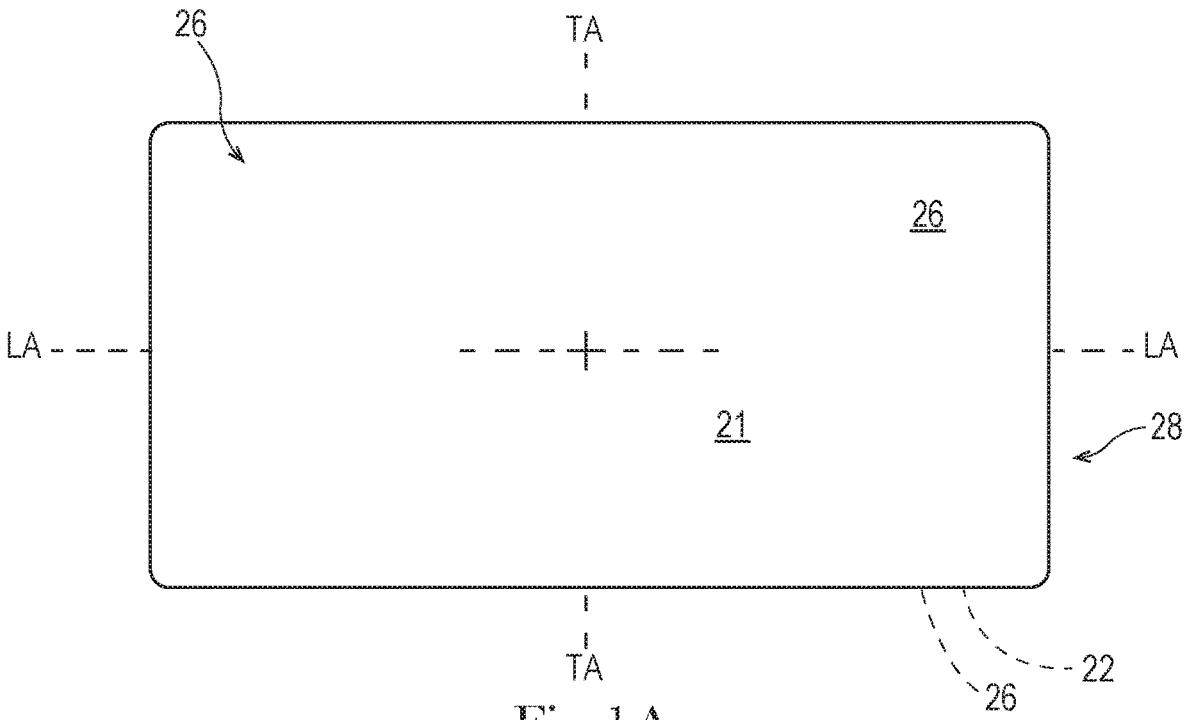
FIG. 1A is a schematic top plan view of a cleaning article, according to the present invention, suitable for use in floor cleaning tasks.
Figure 1B:
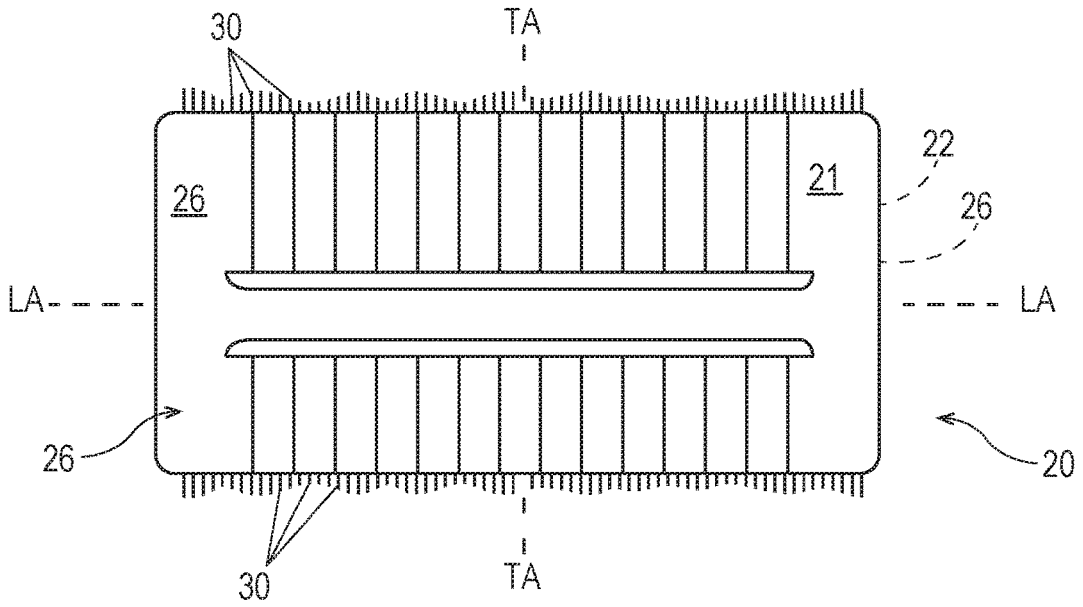
FIG. 1B is a schematic top plan view of a cleaning article according to the present invention, suitable for use as a duster.

Referring to FIGS. 1A-1B, the cleaning article (20) may be disposable. By disposable it is meant that the cleaning article (20) may be used for one cleaning task, or generally for not more than several square meters, then discarded. In contrast, a reusable cleaning article (20) is laundered or otherwise restored after use.

The cleaning article (20) may have a longitudinal axis LA and a transverse axis TA orthogonal thereto. The cleaning article (20), and respective components thereof, may have two longitudinal edges 20 parallel to the longitudinal axis LA and two transverse edges 22 parallel to the transverse axis TA.

Referring to FIG. 1A, in one embodiment the invention comprises a sheet (20). The sheet (20) may be used for cleaning debris such as dust, lint, hair, grass, sand, food crumbs from a target surface. The target surface may be a hard surface, such as a floor, table or countertop, or may be a soft surface such as cloth or fabric.

The term "Z-dimension" refers to the dimension orthogonal to the length and width of the cleaning sheet (20) of the present invention, or a component thereof. The Z-dimension usually corresponds to the thickness of the sheet (20). The term "X-Y dimensions" refers to the plane orthogonal to the thickness of the cleaning sheet (20). The X and Y dimensions usually correspond to the length and width, respectively, of the sheet (20). All percentages, ratios and proportions used herein are by weight unless otherwise specified.

The sheet (20) extends in the X-Y dimensions and has a first surface (21) and a second surface (22) opposed thereto. The sheet (20) may be macroscopically flat, or, preferably, is macroscopically three dimensional. Both the first surface (21) and second surface (22) may be textured in the Z direction. Or preferably, the first surface (21) is textured in the Z direction and the second surface (22) is macroscopically flat.

An essentially flat sheet (20) is defined as a sheet (20) that visually appears to be uniform on a macro scale. While visually flat on a macro scale, on a micro scale these sheets still comprise of high spots (peaks) and low spots (valleys). For these types of flat sheets (20) the peaks and valleys may have an average height differential less than about 0.5 mm.

Flat sheets (20) can further be described by the caliper and basis weight. In a preferred embodiment for a flat sheet (20) the caliper is less than 1 mm and the basis weight is less than 200 grams per square meter. Even a more preferred embodiment the caliper is less than 0.75 mm and basis weight is less than 150 grams per square meter. Textured sheets (20) on the other hand are generally understood to have higher calipers at lower basis weights. In a preferred embodiment for a textures sheet (20) the caliper is greater than 1 mm and the basis weight less than 120, preferably less than 90 and more preferably less than 70, but at least 20 grams per square meter.

As used herein, the term "texture" is used to describe the individual's perception of the spatial variation of visible light due to surface structure of a portion of an object in two dimensions and occurs in the Z dimension. Textures can be visual effects generated by surface roughness and visual illusion created by mere color or pattern. The sheet (20) may have an Average Height Differential of at least about 0.5 mm, more preferably at least about 1 mm, and still more preferably at least about 1.5 mm. The Average Height Differential of at least one outward surface will typically be from about 0.5 to about 6 mm, more typically from about 1 to about 3 mm, as disclosed in commonly assigned U.S. Pat. No. 6,797,357.

Texture may be the result of the natural characteristics of a given material as a result of the material formation process. Textures may also be imparted to a material using techniques known to those skilled in the art including, for example, hydroentangling, printing, embossing, bonding, aperturing and the like.

As used herein, the term "pattern" is used to describe the individual's perception of spatial variation of visible light due to contrasts in spatial variation of light due to the color, form, and texture of a portion of an object incorporated into the object by the manufactory of the elements. This contrast creates various visual distinct regions or lines sometimes referred to as "figures" within its surrounding sometimes referred to as "ground." Patterns can be formed by combinations of contrasting color, form, and texture relative to its surroundings. An element can have more than one pattern, but each pattern would be distinguishable, recognizable, and separate from the other patterns on the element. Pattern is also a term used to describe the observer's perception of combined effect of more than one color, form, or texture within a portion of an observer's field of view. Patterns may have a "length", "extent", "shape", "position" and "orientation".

The sheet (20) can be a woven or nonwoven sheet (20). A textured sheet (20) is preferred, as may be made by a known hydroentangling process using a three-dimensional screen having variation in the Z dimension. The term "hydroentanglement" is a process for making a sheet (20) wherein a layer of loose fibrous material (e.g., polyester) is supported on an apertured patterning member and subjected to water pressure differentials sufficiently great to cause the individual fibers to entangle mechanically to provide a sheet (20). The apertured patterning member can be formed, e.g., from a woven screen, a perforated metal plate, etc.

The sheet (20) may prophetically be a textured formed film, typically polyolefinic, such as LDPE. The sheet (20) may be a laminate of the foregoing.

As described below, the sheet (20) may be pervious to permeation of oil therethough in the Z dimension. The oil may particularly permeate from the first surface (21) to or towards the second surface (22)

Suitable materials for the sheet (20) include, for example, natural cellulose fibers, such as softwoods, hardwoods and blends thereof. Preferred suitable materials include synthetic fibers such as polyolefins (e.g., polyethylene and polypropylene), polyesters, polyamides, synthetic cellulosics (e.g., RAYON®), and blends or laminates thereof. A laminate of PE/PP/PE has been found suitable. The sheet (20) can be biodegradable and comprise virgin and/or recycled fibers.

The nonwoven cleaning sheet (20) may be made according to a hydro-entangling process to provide a texture and a basis weight of about 20 to about 120 gsm. The cleaning sheet (20) according to the present invention may be made according to commonly assigned U.S. Pat. Nos. 6,305,046; 6,484,346; 6,561,354; 6,645,604; 6,651,290; 6,777,064; 6,790,794; 6,797,357; 6,936,330; D409,343; D423,742; D489,537; D498,930; D499,887; D501,609; D511,251 and/or D615,378.

A polymeric net, known as a scrim material, may be incorporated into the sheet (20) though lamination via heat, chemical means such as adhesives and/or hydroentanglement, as described in 4636419. The scrim can be polyethylene, polypropylene, copolymers thereof, poly(butylene terephthalate), polyethylene terephthalate, Nylon 6, Nylon 66, and the like. Incorporation of the scrim material into a cleaning sheet (20), followed by heating, may be used to provide macroscopic three-dimensional character to the sheet (20). This macroscopic three-dimensionality has been found to greatly enhance cleaning performance of the cleaning sheet (20), even where the basis weight of the sheet (20) is essentially uniform. In particular, macroscopic three-dimensionality is achieved when the scrim/fiber composite is subjected to heating, then cooling. This process results in shrinkage (in the X-Y dimension) of the scrim and, as a result of its being attached with the fibers, provides a sheet (20) with greater three-dimensionality.

Referring to FIG. 1B, the cleaning article (20) may have tow fibers (30). The tow fibers (30) may be joined to a sheet and allow for cleaning in small spaces and crevices. Such a cleaning article (20) may have one or more longitudinally oriented sleeves for attachment to a complementary cleaning implement. Such a cleaning article (20) may be made according to U.S. Pat. Nos. 6,813,801; 7,334,287 and/or commonly assigned U.S. Pat. No. 8,161,594.

Generally, the cleaning performance of the sheet (20) may be enhanced by treating the sheet (20) with a variety of coatings, including surfactants or lubricants, which enhance adherence of soils to the sheet (20). Such coatings may be added to the cleaning sheet (20) at a level sufficient to enhance the ability of the sheet (20) to adhere soils, particularly at an add-on level of at least about 0.01%, more preferably at least about 0.1%, more preferably at least about 0.5%, more preferably at least about 1%, still more preferably at least about 3%, still more preferably at least about 4%, by weight. Typically, the add-on level is from about 0.1 to about 25%, more preferably from about 0.5 to about 20%, more preferably from about 1 to about 15%, still more preferably from about 3 to about 10%, still more preferably from about 1 to about 8%, and most preferably from about 4 to about 6%, by weight. The cleaning article (20) may have a coating weight of 1 to 5, 2 to 4, or preferably 2.4 to 3.6 gsm. The coating (26) may be generally uniformly applied to the sheet, or applied in zones, as desired.

As used herein various flowable coatings (26) include oil. The oil is believed to promote desirable tactile feel, and produce a desirable and controlled coefficient of friction on a surface (21, 22) of the sheet (20) for desirable glide on the floor or other target surface. Suitable oils include mineral oil, petroleum jelly silicone, etc. which are free flowing at 20 degrees C., and particularly vegetable oils. The oil and/or other free flowing coating (26) can further comprise surfactant to aid in cleaning and spreading. A preferred coating is a wax, oil or prophetically a mixture thereof.

The oil may have a viscosity less than 1000, preferably less than 500 and more preferably less than 100 centipoise at 20 degrees C., but greater than 5 or 10 centipoise at 20 degrees C. This viscosity range is believed to be adequate to promote spreading of the oil, particularly on the second surface (22) of a hydrophobic sheet (20).

Referring to FIGS. 1A and 1B, the oil may comprise renewable vegetable oil, and particularly soy oil. The oil according to the present invention has less than 45%, 40%, 35%, 30%, 25% hydrogenation, more preferably less than 20% or 10% hydrogenation and even more preferably is un-hydrogenated.

Hydrogenation is measured by the Iodine Value of the soy oil. The soy oil Iodine Value is measured on the soy oil, independent of and not including any other components of the coating. The aforementioned hydrogenation percentages may correspond to Iodine Values greater than 90, 95, 100, 105, 110, 115, 120, 125, 130, 135, 140 and not more than 143. An Iodine Value greater than 96 corresponds to a hydrogenation percentage less than 20%. An Iodine Value greater than 100 corresponds to a hydrogenation percentage less than 10%. An Iodine Value of 120-143 corresponds to an un-hydrogenated oil, having about 0% hydrogenation. Iodine Value is measured by DIN 53241-1:1995-05. Table 1 below shows a range of Iodine Values for various hydrogenations and melting points.

TABLE 1

| Soy Oil | Iodine Value (g I2/100 g substance) | Melting Point |
|---|---|---|
| Natural Soybean Oil | 120-139 | About 0° C. |
| Partially Hydrogenated | 55-70 | About 40-48° C. |
| Fully Hydrogenated | 0-4 | About 60-68° C. |

The coating (26) can also comprise wax. Suitable waxes include various types of hydrocarbons, as well as esters of certain fatty acids (e.g., saturated triglycerides) and fatty alcohols. They can be derived from natural sources (i.e., animal, vegetable or mineral) or can be synthesized. Mixtures of these various waxes can also be used. Some representative animal and vegetable waxes that can be used in the present invention include beeswax, carnauba, spermaceti, lanolin, shellac wax, candelilla, and the like. Representative waxes from mineral sources that can be used in the present invention include petroleum-based waxes such as paraffin, petrolatum and microcrystalline wax, and fossil or earth waxes such as white ceresine wax, yellow ceresine wax, white ozokerite wax, and the like. Representative synthetic waxes that can be used in the present invention include ethylenic polymers such as polyethylene wax, chlorinated naphthalenes such as "Halowax," hydrocarbon type waxes made by Fischer-Tropsch synthesis, and the like.

As shown in Table 2 below, four different oil and wax coatings supplied by Koster Kuenen, of Watertown, Conn. were evaluated, as described below.

TABLE 2

| Weight percentage of constituent | 30 w % Soy Oil. | 10% w Oil | 35 w % Wax | 15 w % Tackifier | 10 w % Fatty Acid |
|---|---|---|---|---|---|
| Sample | Hydrogenation percentage | | | | |
| Control | ~50 | Mineral Oil | MC Wax | Polyisobutylene | Cetyl Palmate |
| 2 | 0 | Mineral Oil | MC Wax | Polyisobutylene | Cetyl Palmate |
| 3 | ~50 | Mineral Oil | Bees Wax | Polyisobutylene | Cetyl Palmate |
| 4 | ~50 | Mineral Oil | Bees Wax + Stearic Wax | Polyisobutylene | Cetyl Palmate |

Referring to Table 3, a nonwoven sheet cleaning article (20) according to the present invention was tested for two performance criteria—debris pickup and debris retention once acquired by the cleaning article (20). A commercially available Swifter® Sweeper™ refill was used as a control. This control was selected as being the market-leading dry refill sheet (20) known to Applicant at the time of filing.

TABLE 3

| | TEST PARAMETER | | PERFORMANCE | |
|---|---|---|---|---|
| Coating | Penetration (dmm) | Tack (Newtons) | Debris Pick-up (unitless) | Debris Retention (unitless) |
| Control | 76 | 1.05 | 56 | 23 |
| Sample 2 | 96 | 1.21 | 54 | 22 |
| Sample 3 | 68 | 1.28 | 61 | 34 |
| Sample 4 | 81 | 1.31 | 60 | 34 |

The hardness of the coating (26) has been found to influence processing and cleaning, as described above. If the coating (26) is too hard, it will be less efficacious in use. If the coating (26) is too soft, it will lead to difficulty in manufacture, and may leave residue during cleaning. The hardness of the coating (26) is principally determined by the hardness of any wax in the coating (26).

The hardness of the wax is measured by needle penetration into the wax, as is known in the art.

The hardness of the wax is measured by ASTM D1321-16a at 20 degrees C. If the hardness of the coating is desired, such hardness is likewise measured according to ASTM D1321-16a at 20 degrees C.

The coating (26) may have a penetration of 70-110 dmm and more particularly 85-100 dmm More particularly the wax comprising the coating (26) may have a hardness falling within the aforementioned ranges.

The coating (26) imparts a coefficient of friction to the sheet (20). If the coefficient of friction is too low, suitable debris pickup may not be accomplished during the cleaning task. If the coefficient of friction is too high, difficulty in cleaning can occur.

A suitable coefficient of friction may range from 0.35 to 0.55, particularly 0.40 to 0.50, more particularly 0.42 to 0.48 or any range therebetween. A coefficient of friction outside of these ranges may be unsuitable, for the reasons described above. Coefficient of friction is measured as the static coefficient of friction according to ASTM D1894, with the substitution of a 30 gram stainless steel sled, having a 6.2×6.2 cm footprint, at a speed of 150 mm/min.

The static coefficient of friction may be related to the weight of the coating (26) on a nonwoven sheet cleaning article (20). If the coating weight is too low or too high, an undesirable static coefficient of friction may result. Sample 2 was run at plant trials, using production speeds, in order to achieve four coatings weights and associated coefficients of friction, as shown in Table 4. The coefficients of friction shown in Table 4 were measured at the plant, using a test method and equipment which were similar, but not identical, to those specified below. Therefore Table 4 is offered for comparative purposes only.

TABLE 4

| Coating Weight (GSM) | Static Coefficient of Friction |
|---|---|
| 1.2 | 0.260 |
| 2.1 | 0.270 |
| 3.0 | 0.227 |
| 3.6 | 0.285 |

Referring to Table 5, it can be seen that Sample 2 according to the present invention has superior processability relative to the Control. Particularly, contamination, as qualitatively observed due to fiber buildup on the equipment, is improved with present invention. Additionally, handling of stacks of the cleaning sheets (20) as portioned into discrete counts for packaging was improved with the present invention, thereby minimizing packaging errors and subsequent scrap.

And referring to Table 6, unexpectedly, the Control and Sample 2 according to the present invention generally have parity cleaning performance Thus, the invention decouples the prior art tradeoff between cleaning efficacy and processability.

TABLE 5

| Composition | Control Uses ~50% hydrogenated oil (PHSO) | Sample 2 Uses 0% hydrogenated soy oil (UHSO) |
|---|---|---|
| Stack Handling (1.2 gsm) | Fair | Good |
| Stack Handling (2.1 gsm) | Poor | Good |
| Stack Handling (3.6 gsm) | Poor | Good |
| Contamination of equipment | Significant contamination noted | Less contamination noted |
| COF, aged sheets | 0.75 | 0.45 |
| Thermal profile, DSC, <30 C. | Transient, semi-solid | No transience |
| Crystallinity, SAXS, cooling study | Well-defined crystallinity (MC wax fast-forming; PHSO slower); slow crystallinity of PHSO may hinder processing | Amorphous and disrupts crystallinity of MC wax; believe coating stayed on sheet better |

TABLE 6

| Composition | Control Uses ~50% hydrogenated soy oil (PHSO) | Sample 2 Uses 0% hydrogenated soy oil (UHSO) |
|---|---|---|
| Pick-up (%) | 56 | 54 |
| Trap & Lock (%) | 23 | 22 |
| Tackiness | 1.05 | 1.21 |
| Glide | Good | Good |

Referring to Table 7, tests were conducted for the Control and Sample 2 according to the present invention using a soil mixture on a ceramic floor. As shown in Table 7, Sample 2 according to the present invention had comparable or improved performance in both debris pickup and retention of that accumulated debris on the sheet (20). Both the Control and Sample 2 were coated at approximately 1.2 gsm.

TABLE 7

| Sample | Debris Pickup (percentage) | Debris Retention (percentage) |
|---|---|---|
| Control | 46.84 | 20.73 |
| Sample 2 | 47.03 | 20.93 |

Referring to Table 8, these tests were extended to three and six runs, to simulate the effect of cleaning multiple rooms or larger spaces with the same sheet. As shown in Table 8, Sample 2 according to the present invention exhibited less contamination and statistically significantly more debris pickup than the Control for multiple test cycles, approximating normal usage.

TABLE 8

| | Cumulative Debris Pickup (grams) | |
|---|---|---|
| Sample | Run 3 | Run 6 |
| Control | 0.58 | 0.92 |
| Sample 2 | 0.61 | 0.99 |

Significantly, and unexpectedly, cleaning performance according to the present invention is upheld, while manufacturing performance improved, as shown in Tables 5-8.

Thus, the coating (26) weight may range from 1-5 gsm, 2-4 gsm, and preferably 2.4-3.6 gsm. It is believed that a coating weight in the claimed ranges may provide a desirable static coefficient of friction.

Coating weight, in milligrams, is determined by measuring the pNMR (Pulsed Nuclear Magnetic Resonance) spin echo signal intensity resulting from mobile protons present in the liquid coating and quantifying total coating level against an external standard calibration curve.

An uncoated substrate may contain a background finish that produces an interfering pNMR signal at measured temperature. Acceptable background noise is ±10% of target sample (e.g. for 20 mg target, 0±2.0 mg).

A Pulsed NMR Maran Ultra 23 Pulsed-NMR Analyzer with 26 mm probe is used. The following settings are used: 0.0000 (Empty Tube) NA 554.91 and 0.0000 (Blank substrate) 0.01 417.81

A constant temperature dry bath capable of holding 15 or more 25 mm diameter glass tubes and heating the lower 5.1 cm of the tubes to 75° C.±1.0° C., VWR Scientific, Cat. #13259-056 or equivalent, four 25 mm sample blocks with metal inserts, dry bath Cat. #13259-210 or equivalent.

Glass sample tubes of 25 mm diameter, a 15 cm or longer non-magnetic thermometer with a range of at least 0 to 100° C. and a sensitivity of at least ±0.5° C., a VWR Scientific Cat. #61105-003 or equivalent, a rubber stopper size 3 having one hole VWR Cat. #59581-200 or equivalent, air or hydraulic lab press 15.2 cm×15.2 cm or larger plate, Carver #3851 or equivalent, VWR, Cat. #53880-048, basis weight die (standards) 100 mm×100 mm (±0.5 mm), a steel rule cutting die with ejection rubber pad on a plywood base, and an analytical balance accurate to 0.0001 grams, Mettler Toledo # AB54-S or equivalent, VWR, Cat. #11274-872 are used.

The bottom 2.5 cm of a 25 mm diameter pNMR tube is filled with mineral oil only (USP grade) without substrate. A long pipet is used to prevent smearing the sides of the tube with mineral oil. This sample will be used to find the spectrometer frequency offset (o1) and P90/P180 pulse widths before setting up the calibration curve.

A 2.54 cm×2.54 cm sample is tared using the balance. A known amount of coating mix in the center of the sample to prepare the calibration standards. The coating mass corresponds to substrate coating levels in "Total Milligrams". Record the mass of the coating to the nearest 0.0001 g.

The sample is rolled with the coating inside the substrate and inserted into the bottom of a pNMR tube using the forceps or glass stirring rod. The sample is contained only in the bottom 2.5 cm (1 inch) of the tube to obtain an accurate pNMR signal. The standards are prepared in screw-capped tubes to prevent sample loss.

The sample to be measured is inserted into the tube. The sample rolled into a cylinder and placed into a numbered glass, pnMR sample tube as described above. Forceps or a glass stirring rod is used to gently push the sample to the bottom of the sample tube. The test sample must be contained only in the bottom 2.5 cm (1 inch) of the tube to get an accurate pNMR signal.

The dry bath is pre-equilibrated to 75° C.±1° C. The bath temperature should be measured by placing a glass tube containing two inches of mineral oil and a thermometer into the dry bath. The thermometer is inserted through a one hole stopper on the top of the glass tube. The thermometer tip is completely submerged in the mineral oil without touching the sides or bottom of the glass tube. The thermometer should be left in the dry bath continuously to allow the operator to verify the dry bath temperature during the process of running samples.

Initial set-up of the Maran 23 MHz spectrometer uses the following parameters:

Pulse sequence HAHN.exe
ID Value ID Value
P90
.AUTOP90
(5.5) NS 16
P180
.AUTOP90
(11.0) RG
.AUTORG
(100)
Dead1 18.0 RD (μs) 2,000,000
Dead2 15.0 Tau (μs) 5,000
SF 23.0 PH1 0213
O1 .AUTOO1 PH2 0213
FW 100,000 PH3 0011
DW 0.5 DS 0
SI 256 RFAO 100

The temperature of the magnet is fixed at 40±0.5° C. A sample and a known standard are placed into the dry bath to equilibrate at 75° C. for 30 minutes. Samples are placed in the probe and analyzed immediately after they are removed from the dry bath to minimize sample cool-down. If samples are allowed to cool, the coating will solidify and the signal attributed to the MC soy wax coating is reduced, potentially leading to invalid results. For example, the Control cited above starts to solidify in 1 minute after removed from the 75° C. dry bath. EasyCal™ software from BrandTech Scientific Inc. is used to load calibration curves using Easy Cal software.

Total milligrams (mg) is entered into the calibration curve and measured for the cut sample substrate. The calculations for reported 'Total mg' are done automatically by the "RI Analysis" software. The NMR HAHN spin echo response is linearly related to the amount of analyte present. A linear least squares regression of the calibration data against the known standard is obtained using the "RI Calibration" software. The regression parameters are provided as:

$$\text{NMR response}=\text{slope}*(\text{Total mg})+\text{intercept}$$

which, upon rearrangement gives:

$$(\text{Total mg})=(\text{NMR response}-\text{intercept})/\text{slope}.$$

The coating weight is divided by the sample size to yield coating weight in gsm.

The coating (26) may be amorphous, to provide better retention on the sheet. An amorphous coating is believed to deposit less residue during manufacture and cleaning.

Figure 2A:
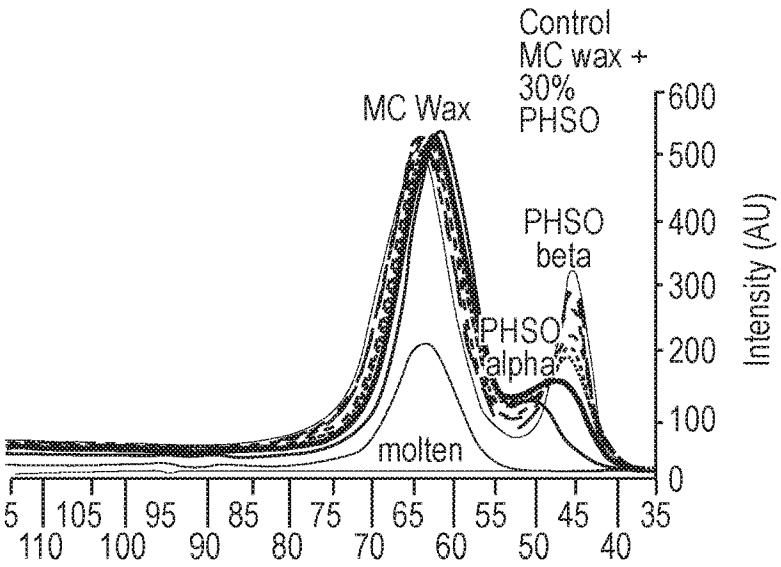
FIG. 2A is a graphical representation of liquid to solid transition as a function of the cooling from 30 C for a control coating.
Figure 2B:
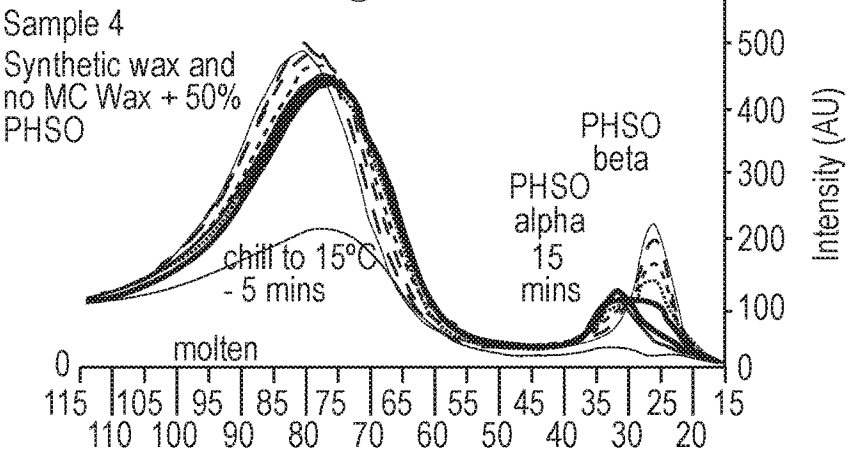
FIG. 2B is a graphical representation of liquid to solid transition as a function of the cooling from 30 C for an alternative coating, listed below as Sample 4.
Figure 2C:
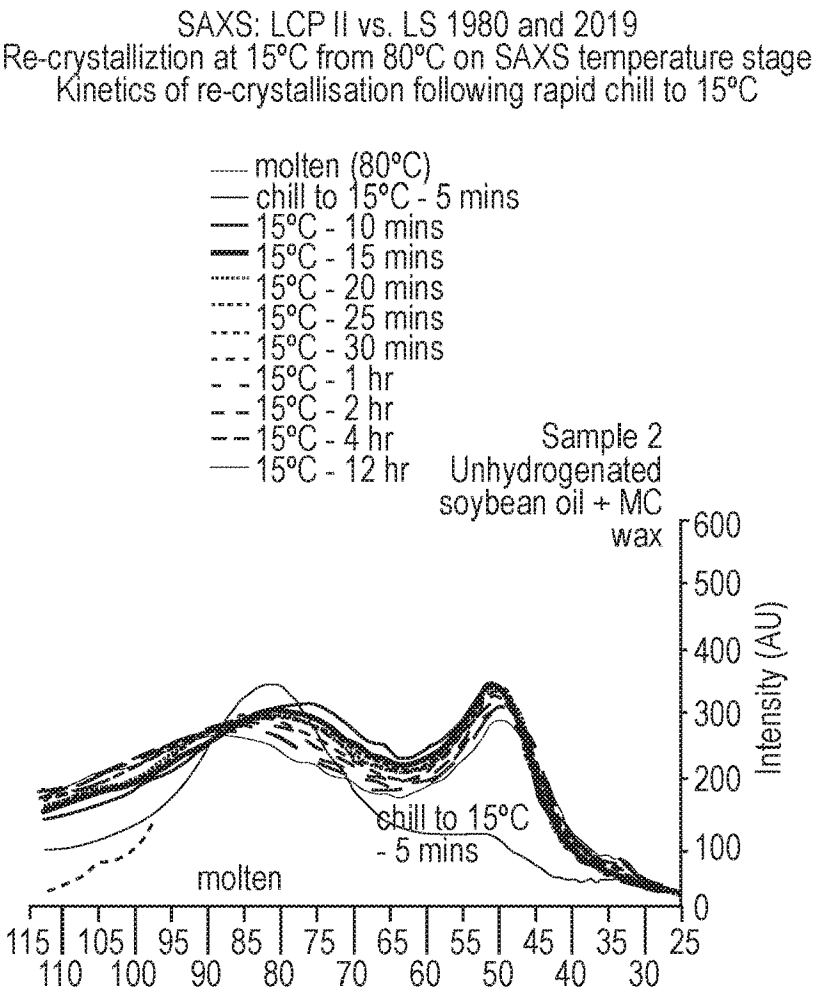
FIG. 2C is a graphical representation of liquid to solid transition as a function of the cooling from 30 C for a coating according to the present invention, listed below as Sample 2.

Referring to FIGS. 2A, 2B and 2C and without being bound by theory, using small angle x-ray scattering (SAXS) it is believed that the phase behavior of the wax can graphically represent the effect on liquid to solid transition as a function of the cooling from 30 C as shown. The Control and Sample 4, respectively exhibit transient behavior particularly around 18-27 degrees C. The present invention, as described in non-limiting Sample 2, unexpectedly does not exhibit this transient response. The absence of the transient response for the wax according to the present invention is believed to unexpectedly improve the processability of coating deposition on the sheet (20) without the tradeoff of sacrificing cleaning performance.

Figure 3:
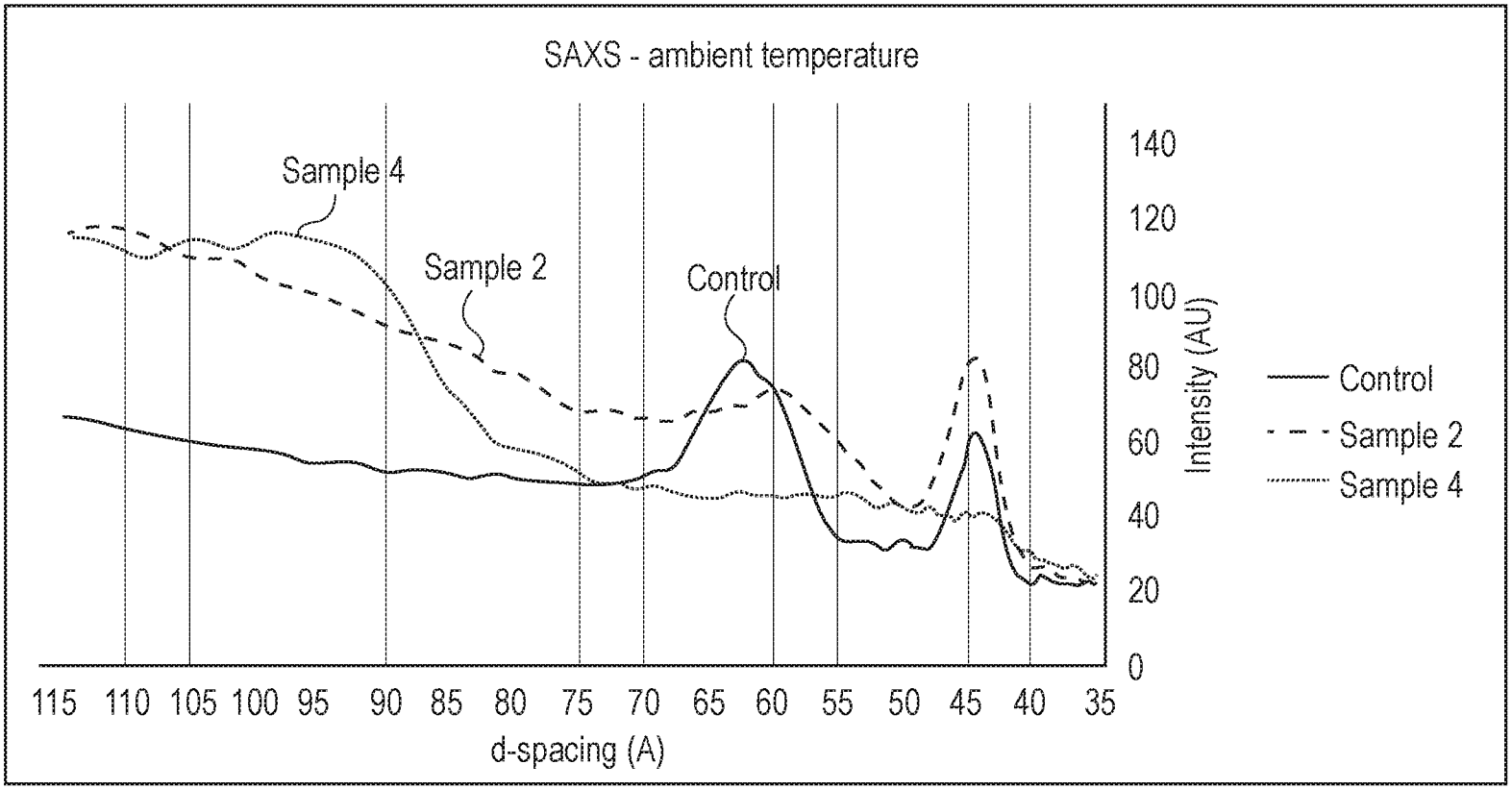
FIG. 3 is a graphical representation of the crystallinity of the coatings in FIGS. 2A, 2B and 2C as a function of d-spacing.

Referring to FIG. 3, the coatings (26) were cooled from 115 degrees to 35 degrees, simulating cooling during manufacture. The Control showed clear peaks for MC (~63 Å d-spacing) and partially hydrogenated soy oil (PHSO) (~45 Å d-spacing). Sample 4 showed the PHSO peak was present but the synthetic beeswax/stearic wax showed a broad peak (~95 Å d-spacing). In contrast, Sample 2, according to the present invention showed very weak crystallinity (42 Å d-spacing) and the micro-crystalline (MC) peak was significantly broader. Thus, the two coatings (26) according to the prior art exhibited steep spikes in AU intensity around 65, 45 and 44 degrees. The coating (26) according to the present invention only had a gradual increase around 59 degrees.

Energy from sources such as heat, ultrasonic vibration, UV and the like can optionally be used to enhance the penetration of oil and/or other free flowing coating (26) into the sheet (20). The coating (26) may be applied to the first surface (21) of the sheet (20), the second surface (22) of the sheet (20) or both surfaces (21, 22) of the sheet (20), using a sprayer, roll coater or slot extruder, as are well known in the art. If roll coating is desired, gravure rolls, lithographic rolls, etc. may be used. The coating (26) may be particularly applied to a surface (21, 22) of the sheet (20) in a uniform coating for simplicity of manufacture. Alternatively, the coating (26) may be applied to a surface (21, 22) of the sheet (20) in MD zones, as is known in the art.

Optionally, a sheet (20) having a textured first surface (21) and flat second surface (22) opposed thereto may be used. The first surface of the sheet (20) may have a uniformly patterned wax disposed on the peaks, but not on the valleys. The pattern on the first surface (21) of the sheet (20) may be continuous or discontinuous. The second surface (22) of the sheet (20) may have oil disposed thereon. The oil may be uniformly disposed throughout the second surface (22), although the oil may also be disposed in any desired continuous or discontinuous pattern. Preferably the wax pattern on the first surface (21) and oil pattern on the second surface (22) are not coincident. This arrangement provides the benefit that oil which penetrates the sheet (20) reaches the valleys, but is blocked from the peaks by the wax.

This optional arrangement provides the benefit that the oil which penetrates through the thickness of the sheet (20) from the second surface (22) towards the first surface (21) reaches the valleys of the first surface (21). But oil is blocked from reaching the peaks of the first surface (21) by the wax. Thus, oil is disposed in the valleys of the first surface (21), but not on the peaks of the first surface (21) coated with the wax.

Gravure printing uses a print cylinder having depressions of varying depths that are etched into the cylinder. This method of printing is performed by partially immersing the etched cylinder into an enclosed fountain or trough of wax, oil or equivalent material. The etched cells, which produce the image, are filled with wax, oil or equivalent material, and the surface the cylinder also becomes coated with wax, oil or equivalent material. Since the surface of the cylinder is non-image producing, wax, oil or equivalent material is not desirable on the cylinder surface. This undesired wax, oil or equivalent material is removed by a doctor blade or knife which wipes all of the surface wax, oil or equivalent material from the cylinder. As the printing cylinder comes in contact with the sheet (20), the wax, oil or equivalent material contained within the cells is transferred to the sheet (20). Gravure is ideal for continuous printing operations and the printing of very long runs. Generally, solvent-based wax, oil or equivalent materials are used in gravure printing.

Lithographic printing, or offset lithography, is a printing method that utilizes surface characteristics on an image carrying offset plate. Offset plates are typically made from a thin paper, plastic, or a metal sheet (20) which once exposed and processed can be wrapped around a cylinder of a press for printing. The offset plate contains two areas: an image area that is hydrophobic and a non-image area that is hydrophilic. While the basic principle is common, there are many differences between offset plates and the method they use to separate the image from the non-image areas. Generally, wax, oil or equivalent material adheres to the hydrophobic image area while being repelled from the hydrophilic non-image area. The wax, oil or equivalent material and watered offset plate may be printed on a second cylinder usually coated in rubber. The second cylinder then off-sets this wax, oil or equivalent material and water impression onto the sheet (20).

Screen printing utilizes a porous screen made from silk or other polymeric material. The screen is attached to a frame. A stencil is produced on the screen either photo-mechanically or manually. The non-printing areas are protected by the stencil. Printing is done on the sheet (20) under the screen by applying a viscous wax, oil or equivalent material to the screen. The wax, oil or equivalent material is forced through the fine openings of the screen with a rubber squeegee or roller.

Figure 4C:
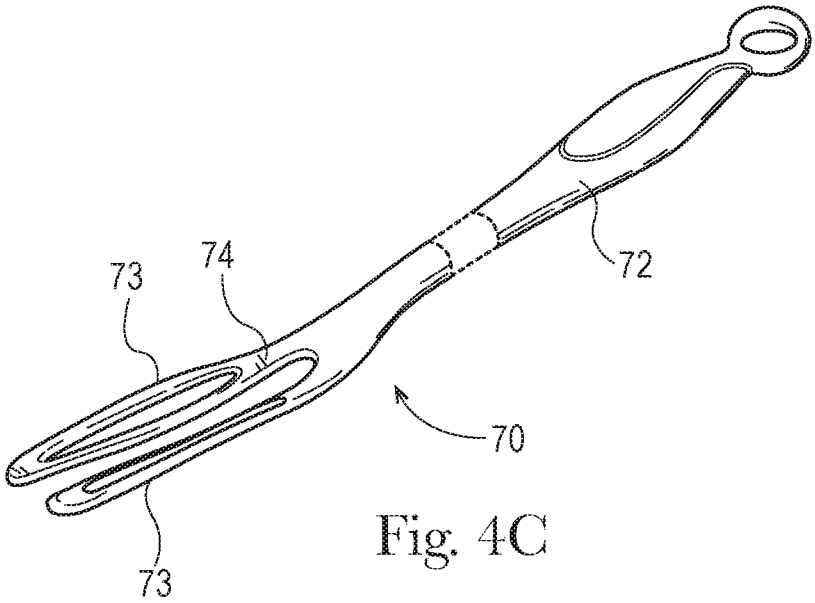
FIG. 4C is a perspective view of a handle suitable for use with a duster type cleaning article according to the claimed invention.
Figure 4A:
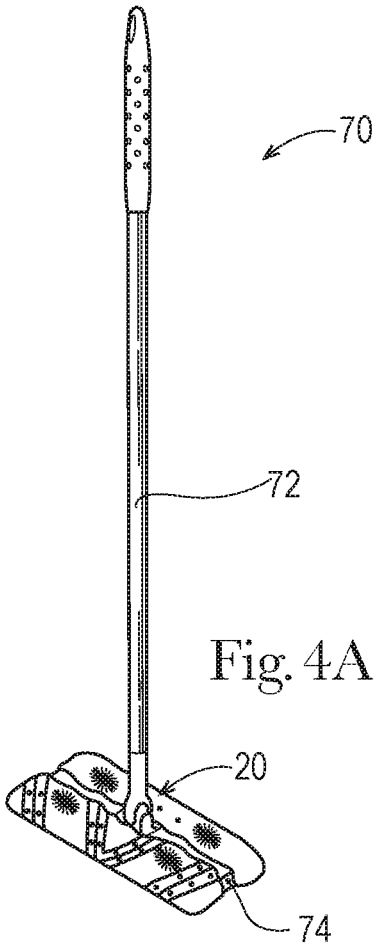
FIG. 4A is a perspective view of a floor cleaning implement suitable for use with the claimed invention and having a cleaning article attached thereto.
Figure 4B:
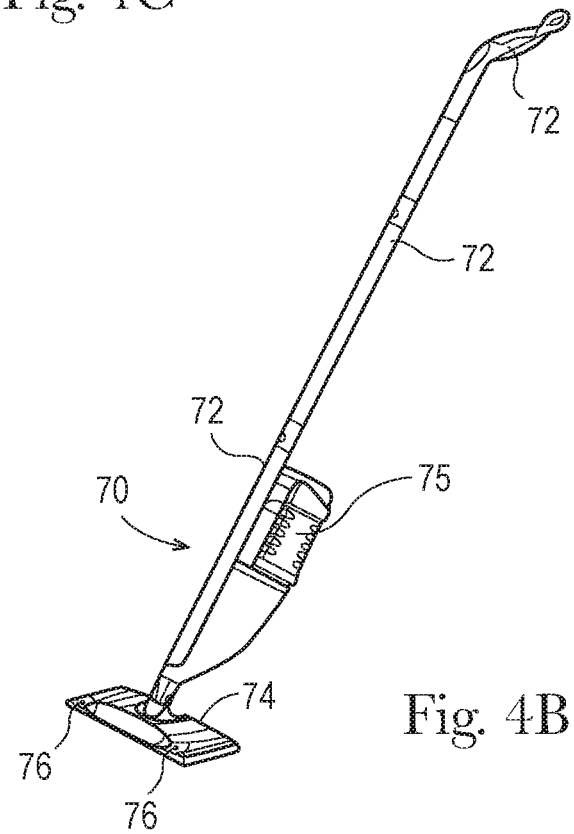
FIG. 4B is a perspective view of a floor cleaning implement suitable for use with the present invention and which sprays liquid cleanser on the floor.

Referring to FIGS. 4A and 4B, the cleaning article (20) may be removably attachable to a cleaning implement (70) for use with dry, wet and/or prewetted cleaning, depending upon the particular task. The cleaning implement (70) may have a head (74) for receiving the cleaning article (20) and an elongate handle (72) joined thereto. A typical floor cleaning implement (70) has a handle (72) for grasping by the user and a head (74) attached thereto, and preferably pivotally attached thereto. The head (74) moves against the floor, or other target surface. The cleaning article (20) may be removably attached to the bottom of the head (74). An attachment system may provide for removable attachment of the cleaning article (20) to a suitable and optional handle (72). Removable attachment of the cleaning article (20) to the implement (70) may be accomplished using adhesive 32, hook and loop systems, elongate sleeves, grippers, etc. Grippers and a suitable cleaning implement (70) are disclosed in commonly assigned U.S. Pat. No. 6,484,356.

Referring to FIG. 4B, the cleaning article (20) may optionally be used with a cleaning solution or other solution usable for other purposes such as treating the surface for appearance or disinfectant, etc. A floor cleaning implement (70) may allow for cleaning of the floor while the user is upright, and may also provide for spraying of cleaning solution or other liquid to the floor from a reservoir 75 through one or more nozzles (76). Suitable spray implements (70) are disclosed in commonly assigned U.S. Pat. Nos. 5,888,006; 5,988,920; 6,842,936; 7,182,537; 7,536,743; 7,676,877 and 8,186,898. The cleaning solution may be pre-applied to the cleaning article (20), creating a pre-moistened cleaning article (20) or may be contained within a separate reservoir (75) for dosing onto the cleaning article (20) and/or target surface. The cleaning solution may comprise a majority water, and at least about 0.5, 2, 5 or 10 weight percent solids, or at least about 30 or 50 weight percent aqueous solvents, non-aqueous solutions or mixtures thereof. A suitable implement (70) having an optional vacuum is disclosed in U.S. Pat. No. 7,137,169.

Referring to FIG. 4C, for use with the cleaning article (20) of FIG. 1B, the implement (70) may have a handle (72) and head (74) used in fixed relationship and comprising one or more tines (73). The tines (73) may be inserted into sleeves in the cleaning article (20). This arrangement allows the cleaning article (20) to be conveniently used as a duster for cleaning small object and tight spaces. Suitable implements (70) for a duster type cleaning article (20) are disclosed in commonly assigned U.S. Pat. No. 8,578,564 and D674,949 S.

If desired, the cleaning article (20) may be used with and removably attached to an autonomously moving robot or drone. Suitable examples of robots and drones for use with the cleaning article of the present invention are found in commonly assigned U.S. Pat. Nos. 6,941,199; 6,810,305; 6,779,217; 6,481,515; 6,459,955 and Ser. No. 14/992,195, filed Jan. 11, 2016, P&G Case 14189. Examples of robots for use with wet and dry cleaning are found in U.S. Pat. Nos. 7,389,156; 8,774,966 and 8,855,813. A data control system may be utilized with the cleaning article (20), as described in U.S. Pat. No. 7,431,524.

The cleaning article (20) may also be used manually, without a handle (72) or implement (70). If desired, various cleaning articles (20) described herein may be packaged and sold in a kit. This arrangement provides the benefit that the user has a choice of different cleaning articles (20) for different tasks. For example, if desired, plural sizes of the cleaning articles (20) may be sold together as a single kit. This arrangement allows the user to select the particular cleaning article (20) best suited for the immediate task.

Combinations

Without limitation, the invention may be made according to any of nonlimiting paragraphs A-T, or according to other embodiments as well.

A. A cleaning article (20) for cleaning a target surface, said cleaning article (20) comprising:

a sheet having a first surface (21) (21) and second surface (22) opposed thereto;

and a coating (26) having soy oil disposed on said sheet for retaining debris thereon, characterized by said soy oil having an Iodine Value greater than 100.

B. A cleaning article (20) according to paragraph A wherein said soy oil has an Iodine Value greater than 110.

C. A cleaning article (20) according to paragraphs A or B wherein said soy oil has an Iodine Value greater than 110 and wherein said coating (26) further comprises MC wax.

D. A cleaning article (20) according to paragraphs A, B or C wherein said soy oil has an Iodine Value greater than 110 and said coating (26) further comprises MC wax, said coating (26) being free of beeswax.

E. A cleaning article (20) according to paragraphs A, B, C or D wherein said soy oil has an Iodine Value greater than 110 and said coating (26) further comprises MC wax, said soy oil and said MC wax comprising from 60 to 85 w % of said coating (26), said coating (26) being free of beeswax.

F. A cleaning article (20) according to paragraphs A, B, C, D or E wherein said soy oil has an Iodine Value greater than 110 and said coating (26) further comprises beeswax, said soy oil and said MC wax comprising from 60 to 85 w % of said coating (26), the balance of said coating (26) comprising a tackifier and a fatty acid.

G. A cleaning article (20) for cleaning a target surface, said cleaning article (20) comprising:

a nonwoven sheet having a first side (21) and second surface (22) opposed thereto;

and a coating (26) having soy oil, said coating (26) being disposed on said first side (21) of said sheet for retaining debris thereon, characterized by said soy oil having an Iodine Value greater than 100, said first side (21) of said sheet having a static coefficient of friction of about 0.35 to about 0.55.

H. A cleaning article (20) according to paragraph G wherein said coating (26) further comprises MC wax, said coating (26) having a penetration of 70 to 110 dmm.

I. A cleaning article (20) according to paragraphs G or H wherein said coating (26) further comprises MC wax, said coating (26) having a penetration of 70 to 110 dmm, said soy oil having an Iodine Value greater than 110.

J. A cleaning article (20) according to paragraphs G, H or I wherein said coating (26) further comprises MC wax, said coating (26) having a penetration of 85 to 100 dmm, said soy oil having an Iodine Value greater than 110.

K. A cleaning article (20) according to paragraphs G, H, I or J wherein said coating (26) further comprises MC wax, said coating (26) having a penetration of 85 to 100 dmm, said soy oil having an Iodine Value greater than 110, said sheet being hydroentangled to have peaks and valleys, said coating (26) being preferentially applied to said peaks of said sheet.

L. A cleaning article (20) for cleaning a target surface, said cleaning article (20) comprising:

a sheet having a first side (21) and second surface (22) opposed thereto;

and a coating (26) having soy oil disposed on said cleaning article (20) for retaining debris thereon, characterized by said soy oil having an Iodine Value greater than 100, and said coating (26) having a coating (26) weight of 1 to 5 gsm.

M. A cleaning article (20) according to any preceding paragraph further comprising tow fibers (30).

N. A cleaning article (20) according to paragraph M wherein said coating (26) is disposed on said tow fibers (30).

O. A cleaning article (20) according to paragraphs L, M and N having a coating (26) weight of 2.4-3.6 gsm and an Iodine Value greater than 110.

P. A cleaning article (20) according to any preceding paragraph wherein said coating (26) is generally amorphous.

Q. A cleaning article (20) according to any preceding paragraph wherein said sheet comprises PET fibers.

R. A cleaning article (20) according to any preceding paragraph wherein said sheet comprises rPET fibers.

S. A cleaning article (20) according to any preceding paragraph wherein said sheet comprises layer of PP fibers with and a layer rPET fibers.

T. A cleaning article (20) according to any preceding paragraph wherein said sheet comprises two layer of rPET fibers with and a layer PP fibers therebetween.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning article for cleaning a target surface, said cleaning article comprising:

a sheet having a first surface and second surface opposed thereto;

and a coating having soy oil and MC wax disposed on said sheet for retaining debris thereon, said soy oil having an Iodine Value greater than 120, said MC wax comprising from 60 to 85 w % of said coating, the balance of said coating comprising a tackifier and a fatty acid, said coating being free of beeswax and coating having a penetration of 85 to 100 dmm.

2. A cleaning article for cleaning a target surface, said cleaning article comprising:

a nonwoven sheet having a first surface and second surface opposed thereto; and a coating having soy oil and MC wax, said coating being disposed on said first surface of said sheet for retaining debris thereon, said soy oil having an Iodine Value greater than 120, said first surface of said sheet having a static coefficient of friction of about 0.35 to about 0.55, said coating having a penetration of 85 to 100 dmm, said sheet being hydroentangled to have peaks and valleys, said coating being only applied to said peaks of said sheet.

3. A cleaning article for cleaning a target surface, said cleaning article comprising:

a sheet having a first surface and second surface opposed thereto;

tow fibers;

and a coating having soy oil and MC wax disposed on said cleaning article for retaining debris thereon, said soy oil having an Iodine Value greater than 120, said coating having a coating weight of 2.4 to 3.6 gsm, said coating is disposed on said tow fibers, said coating being free of beeswax and coating having a penetration of 85 to 100 dmm.

4. A cleaning article according to claim 3 wherein said coating is generally amorphous.

5. A cleaning article according to claim 3 wherein said sheet comprises PET fibers.

6. A cleaning article according to claim 5 wherein said sheet comprises rPET fibers.

7. A cleaning article according to claim 3 wherein said sheet comprises layer of PP fibers with and a layer rPET fibers.

8. A cleaning article according to claim 3 wherein said sheet comprises two layer of rPET fibers with and a layer PP fibers therebetween.

* * * * *